US006240684B1

(12) United States Patent
Bigelow

(10) Patent No.: US 6,240,684 B1
(45) **Date of Patent: *Jun. 5, 2001**

(54) PORTABLE AUTOMOTIVE SERVICE BUILDING

(76) Inventor: William H. Bigelow, P.O. Box 7064, Houston, TX (US) 77248

( * ) Notice: Subject to any disclaimer, the term of this patent is extended or adjusted under 35 U.S.C. 154(b) by 0 days.

This patent is subject to a terminal disclaimer.

(21) Appl. No.: 09/492,591

(22) Filed: Jan. 27, 2000

Related U.S. Application Data

(63) Continuation-in-part of application No. 09/280,455, filed on Mar. 30, 1999, which is a continuation-in-part of application No. 09/033,968, filed on Mar. 3, 1998, now Pat. No. 6,088,969, which is a continuation-in-part of application No. 08/887,167, filed on Jul. 2, 1997, now Pat. No. 5,864,992.

(51) Int. Cl.[7] ..... E04B 7/02

(52) U.S. Cl. ..... 52/174; 52/90.1; 52/92.1; 52/92.3; 52/93.1; 52/93.2

(58) Field of Search ..... 52/174, 90.1, 92.1, 52/92.3, 93.1, 93.2

(56) References Cited

U.S. PATENT DOCUMENTS

| | | | | |
|---|---|---|---|---|
| 1,357,022 | * | 10/1920 | Bahls | 52/174 |
| 3,079,871 | * | 3/1963 | Brodie | 52/174 |
| 3,277,621 | * | 10/1966 | Merdich | 52/174 |
| 3,505,768 | * | 4/1970 | Bentley | 52/174 |
| 3,600,866 | * | 8/1971 | Griffith | 52/174 |
| 3,747,290 | * | 7/1973 | Barrell et al. | 52/90 |
| 4,122,639 | * | 10/1978 | Barrell | 52/90 |
| 4,274,234 | * | 6/1981 | Abell | 52/63 |
| 4,789,047 | * | 12/1988 | Knobloch | 52/174 |
| 4,901,484 | * | 2/1990 | Santosuosso | 52/90 |
| 4,942,712 | * | 7/1990 | Thompson | 52/90 |
| 5,473,844 | * | 12/1995 | Martin | 52/174 |
| 5,720,135 | * | 2/1998 | Paquette | 52/174 |
| 5,864,992 | * | 2/1999 | Bigelow | 52/90.1 |

* cited by examiner

*Primary Examiner*—Carl D. Friedman
*Assistant Examiner*—Dennis L. Dorsey
(74) *Attorney, Agent, or Firm*—Guy McClung

(57) ABSTRACT

The present invention discloses, in certain aspects, a portable building with a plurality of interconnected walls defining an interior space therebetween, a floor on which the walls are positioned, a roof structure connected on top of the walls, and at least one bay area for servicing an automobile. In one aspect there are a pluralities of bay areas. In one aspect the building is removably mounted on a trailer.

16 Claims, 8 Drawing Sheets

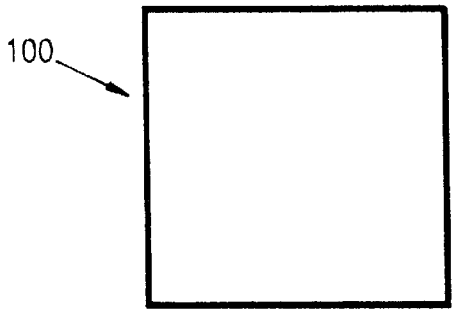
FIG. 3A
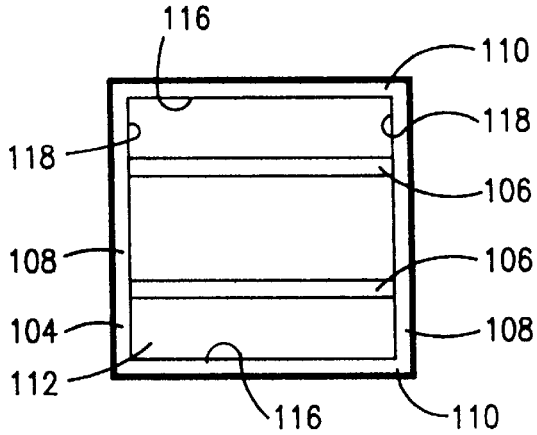
FIG. 3B
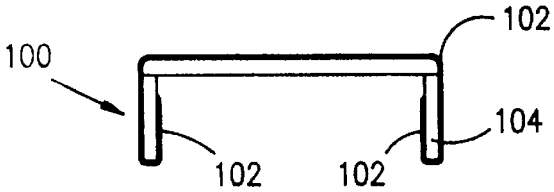
FIG. 3C
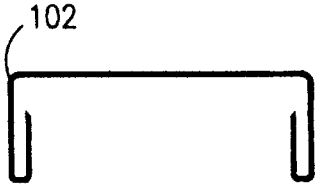
FIG. 3D
FIG. 3E
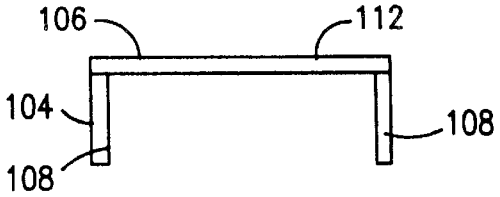
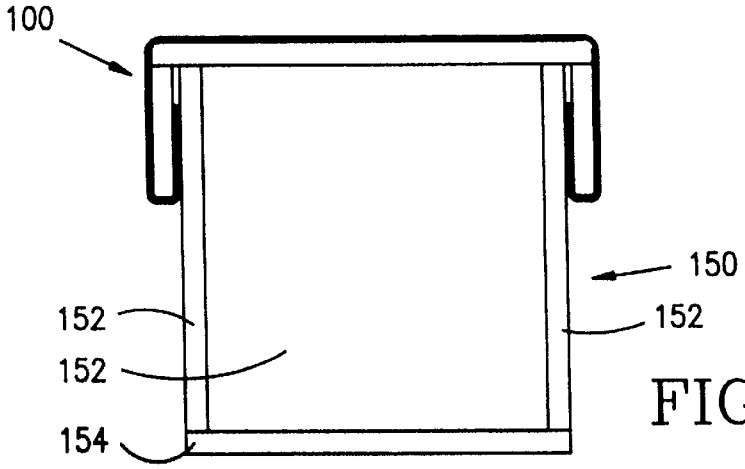
FIG. 4

PORTABLE AUTOMOTIVE SERVICE BUILDING

RELATED APPLICATIONS

This is a continuation-in-part of U.S. application Ser. No. 09/280,455 filed Mar. 30, 1999 entitled "Portable Building" which is a continuation-in-part of U.S. application Ser. No. 09/033,968 filed on Mar. 3, 1998 entitled "Roof and Portable Building," issued as U.S. Pat. No. 6,088,969 on Jul. 18, 2000 which is a continuation-in-part of U.S. application Ser. No. 08/887,167 filed Jul. 2, 1997 entitled "Roof And Portable Building" issued as U.S. Pat. No. 5,864,992 on Feb. 2, 1999, all co-owned with the present invention, all applications and patents incorporated fully herein for all purposes.

BACKGROUND OF THE INVENTION

1. Field of the Invention

This invention is directed to: buildings and parts thereof with coatings or coverings, including portable buildings; roofs for buildings; roofs for portable buildings; integral roofs for buildings; buildings with such a roof; and, in one particular aspect, such a building for use in the automotive repair and service industries.

2. Description of Related Art

The prior art discloses a variety of portable buildings and buildings assembled from prefabricated building elements. Many such buildings have been used for various functions in the automotive repair and service industry; however, in the past such buildings did not provide for easy portability and enlargement.

It is known in the art to place a single-piece roof structure or truss system on the walls of a portable building and to secure it to the walls, and to cover the top and outer sides of such a roof structure with a layer or membranes of protective material such as rubber, rubber roof membrane, flexible plastic, elastomeric material, and fiberglass. Prior art roof trusses are made of metal (e.g. aluminum or steel), wood, fiberglass or some combination thereof.

In certain prior art systems, one or several pieces or panels of roof covering or "membrane" material are installed on top of a roof; and, when multiple pieces are used, to join and seal them together. Such roof coverings are secured to the underlying roof by adhesives, or other suitable fasteners. In certain prior art a fiberglass covering is used, and in others the edges or joints between a roof covering and an underlying roof are sealed with a separate member (e.g. a flashing or batten). The top edges of vertical walls on which the roof is to be positioned are covered with a protective apron. With other prior art roof structures a metal plate is used on the top outer edge of the structure to seal abutting members used to make the roof structure. In one prior art system a trough or support is attached around the vertical walls and a lower edge of the roof is received and held in the trough or support.

In various prior art systems interfaces between roof and walls and between roof holders or supports and a roof need to be sealed, often requiring the use of an additional member. The use of roof holders, e.g. "J" rails, requires the emplacement and attachment of the "J" rails to the walls.

There has long been a need for buildings and parts thereof, including portable buildings, with components coated and/or covered with protective material. There has long been a need for an efficient and effective roof for portable buildings. There has long been a need for such a roof that has protected edges and which does not present roof/wall sealing problems. There has long been a need for a simple roof structure that also seals a roof/wall interface.

SUMMARY OF THE PRESENT INVENTION

The present invention, in certain aspects, discloses a portable building with a plurality of interconnected walls defining an interior space therebetween, a floor on which the walls are positioned, a roof structure connected on top of the walls, and at least one (or a plurality of) bay area for servicing an automobile.

The present invention, in certain embodiments, discloses a portable building useful in the automotive service and repair industries that has a roof, which in certain aspects is a typical prior art roof or is a roof as described below; one, two, three or more bay areas for working on automobiles; at least one storage area; at least one waiting area; at least one office area; at least one bathroom area; and central air conditioning and/or heating apparatus. In certain aspects such a building has a roof with protective material thereon, and, in certain aspects is coated with any suitable coating, including but not limited to, commercially available spray-on coating, e.g., but not limited to, Line-X coatings. In certain aspects, such a building is essentially a box with a floor, four walls, and a roof over the floor connected to the walls. It may have a series of pane windows that form a storefront, a drop ceiling in any desired area (including, but not limited to, in the waiting area, office area, and/or bathroom areas); a tiled floor in any desired area; a coated floor in any desired area, including but not limited to, in the bay area(s); and/or roll-up garage doors for the bay area(s). Such a building is easily installed at an original location (owned or leased) and easily re-located to a new location. Such a building can be temporarily located in a test location and then left there or moved depending on the test results.

The present invention, in certain embodiments, discloses a roof structure for a building (including, but not limited to a portable building and/or a building made of prefabricated elements) that includes a plurality of walls; roof support or truss; a top roof member or members on the roof truss; and a roof covering that covers the top roof member, the sides or "apron" of the roof truss, and which at least wraps under a bottom edge of the roof truss both to protect the roof truss and to enhance securement of the roof covering on the roof truss. In one aspect the roof covering wraps over the lower roof edge and extends up on the apron's interior surface. In another aspect such an extending portion of the roof covering serves as a sealing gasket between the roof and the upper portion of the walls.

In one aspect the roof covering is a single piece of flexible material or fabric or is an integral unit, coating, and/or covering applied on the roof truss. In another aspect the roof covering is made of a series of panels, pieces sections, e.g. of rubber, plastic, fiberglass or rubber roof membrane that are arranged side-by-side on top of the roof truss and then sealed together at their abutting edges and glued on the top roof member and on the apron of the roof truss. In one aspect at least part of the apron's interior surface is covered by the material.

In one aspect, a lower overlapping edge of the roof covering that projects beneath the bottom of the roof truss system may be farther secured to the roof truss system or to the walls with appropriate nails, staples, screws, bolts, or other fasteners.

In one aspect the roof material is flexible rubber, flexible synthetic material, flexible plastic, flexible fiberglass, rubber roof membrane material whose thickness ranges between 0.025 and 1.00 inches. In one particular embodiment a single piece of rubber roof membrane about 0.065 inches thick is used to cover the entire top deck of a truss and the sides or apron.

In one aspect the roof material is a thermoplastic polyurethane/polyurea or thermoplastic polyurea (collectively referred to herein as "spray-on thermoplastic polyurethane" materials). Such materials may be used as two component spray-in-place flexible 100% solids materials as are known and commercially available. In certain embodiments such materials are sprayed-on and set with a thickness of between about 1/16" and about 3/8"; in one aspect, with a thickness between about 1/8" and 1/4"; and, in one aspect, about 3/16" thick.

The present invention also discloses a method for applying a roof covering to a roof truss and for repairing such a roof covering. The roof material is attached or glued on the top and on outer sides of the roof apron with any suitable adhesive as well as on an inner portion of the sides or apron. Known repair methods for repairing holes or cuts in rubber, plastic, synthetic material, or fiberglass are used to repair such damage to the roof material. Known seam connection, adhering or welding techniques are used to connect and seal seams when multiple pieces are used. Electrical and/or air conditioning conduits and ducts may be disposed in the roof truss.

The present invention discloses, in certain embodiments, a building with a floor, walls connected to the floor, and any new roof structure as described herein secured to the walls. In one aspect the floor, walls, and roof are all treated with the spray-on materials disclosed herein, on an inside surface, on an outside surface, or on both. Also, it is within the scope of this invention to treat the floor or walls alone and/or a skid, foundation, or support on which a building is mounted.

The present invention discloses, in certain embodiments, a roof structure for a building, the roof structure having a roof support having an outer edge, and a roof covering on the roof support, the roof covering having a lower lip projecting inwardly beneath the outer edge of the roof support; such a roof structure wherein the outer edge of the roof support comprises two pairs of opposed edges; such a roof structure wherein the roof covering covers some or substantially all of the roof support, in one aspect all exterior surfaces and some or all of the interior surfaces; such a roof structure wherein the walls have top ends disposed within the roof support and the roof covering has inner ends disposed between a top interior surface of the roof support and the top ends of the walls; such a roof structure wherein the roof support is a truss with a top member, a bottom member, side members interconnected between the top and bottom members, and, optionally, intermediate supports extending between the side members; such a roof structure wherein the roof covering is made of rubber roof membrane material; such a roof support wherein the roof covering is about 0.05 inches thick, about 0.65 inches thick or ranges in thickness between about 0.025 about 0.085 inches; such a roof structure wherein the roof support is positionable on upright walls of a building with top portions of the walls within the roof support, and wherein the side members have lower ends, the roof structure also having protectors covering at least a portion of the lower ends, such in one aspect protectors also disposable such that and of a small enough thickness that they facilitate the emplacement of the roof structure over upright walls of a building and/or prevent snagging of the roof material during emplacement; such a roof structure wherein the lower lip is secured to the roof support by at least one fastener passing through the roof covering and into the roof support; such a roof structure wherein the roof support has interconnected sides having an outer surface and an inner surface, and the roof covering covers the outer surfaces of the sides of the roof support and at least a portion of the inner surfaces of the sides of the roof support, or substantially all thereof.

The present invention, in certain embodiments, discloses a roof structure for a building, the roof structure having a roof support having an outer edge, and a roof covering of roof material on the roof support, the roof covering having a lower lip projecting downwardly past a lower edge of the roof support, in one aspect for attachment to a part of a wall or inwardly beneath the outer edge of the roof support, the outer edge of the roof support having at least two pairs of opposed edges, and wherein the roof covering covers and is glued to some or all of the roof support; such a roof structure wherein the roof support has interconnected sides having an outer surface and an inner surface, and the roof covering covers the outer surfaces of the sides of the roof support and at least a portion of the inner surfaces of the sides and or ceiling of the roof support.

The present invention discloses, in certain embodiments, a building with a plurality of interconnected walls defining an interior space therebetween, an optional floor on which the walls are positioned, and a roof structure connected on top of the walls, the roof structure having a roof support having an outer edge, and a roof covering on the roof support, the roof covering having a lower lip projecting inwardly toward the walls beneath the outer edge of the roof support or downwardly past a lower end of the roof structure; such a building wherein the outer edge of the roof support has at least two pairs of opposed edges and the roof covering lower lip is positioned adjacent to and beneath the two pairs of opposed edges; such a building wherein the roof covering covers the roof support; such a building wherein the walls have top ends disposed within the roof support and the roof covering has inner ends disposed between a top interior surface of the roof support and the top ends of the walls; such a building wherein the roof support is a truss with a top member, a bottom member, side members interconnected between the top and bottom members, and optional intermediate supports extending between the side members; such a building wherein the roof support is positionable on upright walls of a building, with top portions of the walls within the roof support, and wherein the side members have lower ends, the roof structure also having protectors covering at least a portion of the lower ends, angle pieces, and/or attachment pieces connected to the roof support for holding the roof material, for facilitating emplacement of a roof structure on walls, for serving as a seal and/or gasket, an/or for preventing snagging of roof material; such a building wherein the roof support has interconnected sides having an outer surface and an inner surface, the roof covering covers the outer surfaces of the sides of the roof support and at least a portion of the inner surfaces of the sides of the roof support, each wall having a top portion within the sides of the roof support, and the roof covering acting as a sealing gasket between the inner surfaces of the sides of the roof support and the top portion of the walls.

The present invention, in certain embodiments, discloses a method for connecting a roof structure and walls of a building structure, the method including positioning a roof structure above the interconnected walls of a building structure, the roof structure having a roof support with interconnected sides having an outer surface and an inner surface, a roof covering that covers the outer surfaces of the sides of the roof support and at least a portion of the inner surfaces of the sides and/or ceiling of the roof support, each wall having a top portion within the sides of the roof support, and lowering the roof structure onto the walls with a sealing fit so that a portion of the roof covering is disposed between the inner surfaces of the sides of the roof support and the top portion of the walls. In one aspect the roof material of the roof covering itself acts as a seal and/or gasket. In another aspect protectors, angle pieces, and/or attachment pieces as described above and herein are used in such methods.

It is, therefore, an object of at least certain preferred embodiments of the present invention to provide:

New, useful, unique, efficient, nonobvious buildings with one or more automobile bay service areas;

New, useful, unique, efficient, nonobvious devices and methods for roof structures for buildings, methods for their use and installation, and buildings with such a roof structure;

Such a roof structure with a roof covering lower edge that overlaps and covers an outer bottom edge of a roof apron or bottom of an outer side of a roof truss; covers a portion of a wall; and/or in one aspect, covers a portion or all of the inner surface of the roof side or apron;

Such a roof structure with such a roof covering that is adhesively adhered to the roof truss;

Such a roof structure with a flexible covering extending up into the structure's interior which serves as a sealing gasket and/or shock absorber between the roof structure and the walls;

Such a roof structure that eliminates the need for seals, seam covers, or flashings at certain locations on a building, including, but not limited to, at roof/wall interfaces;

Such a roof structure with an easily repairable roof covering; and

A building with any such roof structure and/or any such roof covering.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one skilled in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

FIG. 3A is a top view of a roof structure according to the present invention; FIG. 3B is a bottom view of the roof structure of FIG. 3A; and FIG. 3C is a cross-sectional view of the roof structure of FIG. 3A.

FIG. 3D shows the roof covering of the roof structure of FIG. 3A and FIG. 3E shows the roof truss of the roof structure of FIG. 3A.

FIG. 4 is a side cross-sectional view of a building according to the present invention with a roof structure as in FIG. 3A.

DESCRIPTION OF EMBODIMENTS PREFERRED AT THE TIME OF FILING FOR THIS PATENT

Figure 1A:
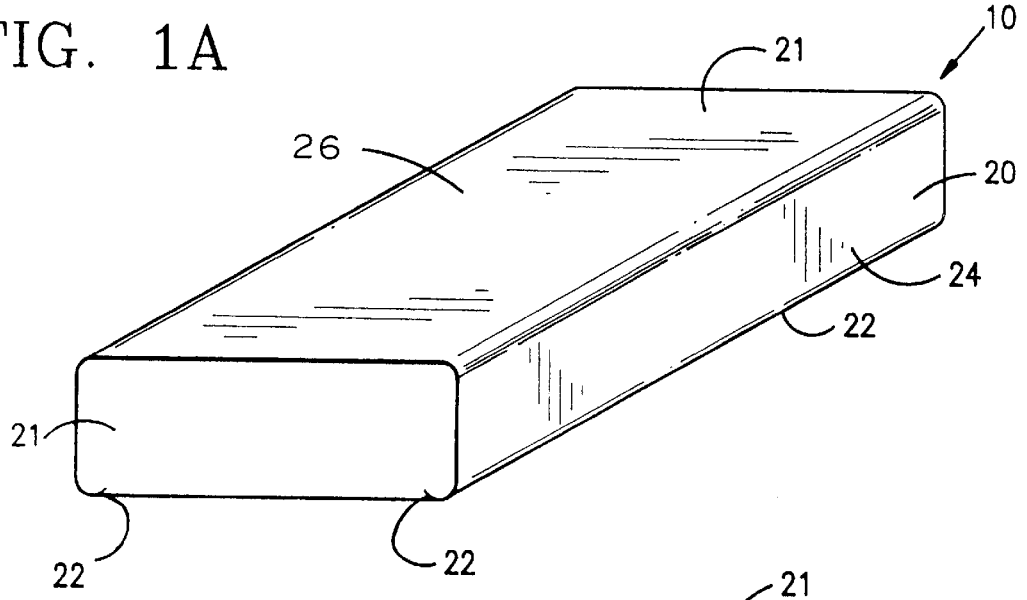
FIG. 1A is a perspective view of roof structure according to the present invention.
Figure 1B:
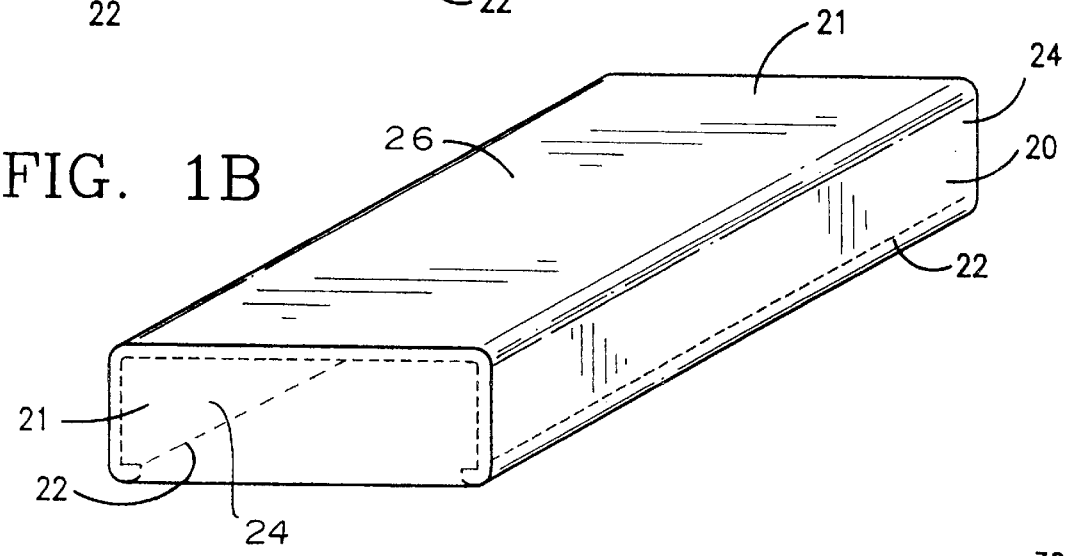
FIG. 1B is a perspective view of a roof covering according to the present invention.

FIG. 1A shows a roof structure 10 according to the present invention with a roof covering 20 and a roof truss 30 therein. The roof covering 20 has ends 21 and lower lips 22 that project in from opposed sides 24 beneath a bottom 32 of the roof truss 30. A top 26 spaces apart the sides 24. The roof covering 20 is a single piece made separately that is placed on and then glued to the roof truss 30.

In another embodiment the roof covering 20 is initially made up of separate pieces of material placed on the top and sides of the roof truss 30. Edges of the pieces are sealed or welded together to form an integral covering.

Figure 1C:
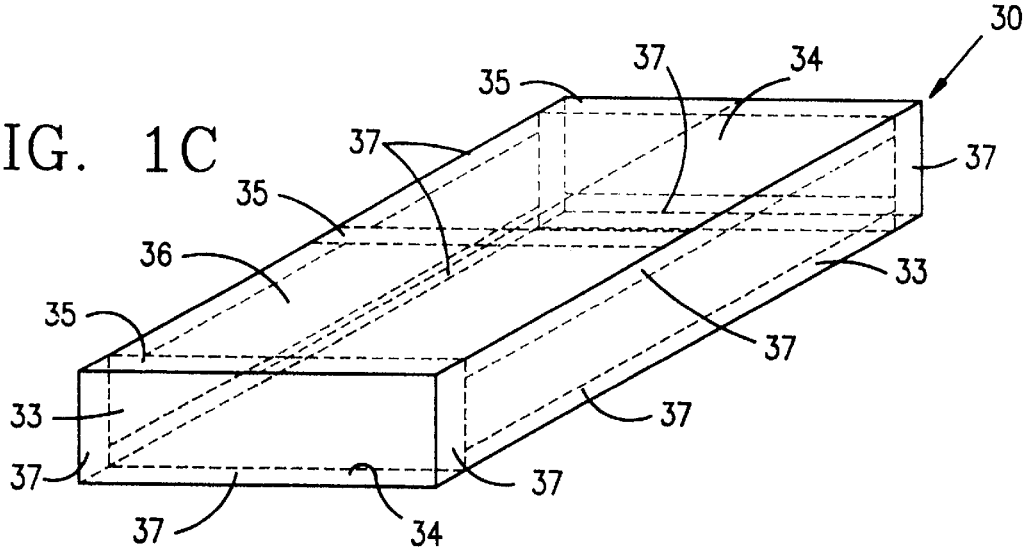
FIG. 1C is a perspective view of a roof truss according to the present invention.

The roof truss 30, FIG. 1C (which is within the roof covering 20 in FIG. 1A), has sides or aprons 33, ends 34, internal rafters 35 and supports 37, and a top member 36. In one aspect the top member 36 is eliminated.

The lip 22 may be larger or smaller than shown. It is within the scope of this invention for the lip to project inwardly to contact a building wall and, in one aspect, to extend downwardly to cover part of the wall. Alternatively, part of the roof covering 20 may extend upwardly between the roof truss 30 and a wall of a building. The roof covering 20 may be any desired thickness and, in certain preferred embodiments, ranges between 0.025 inches and 1.00 inches thick. In one particular embodiment the roof covering 20 is commercially available rubber roof membrane material about 0.065 inches thick.

As shown the ends 34 of the roof truss 30 are covered by the roof covering 20. It is, however, within the scope of this invention for the roof covering not to cover the ends 34 or to partially cover them. Alternatively, separate pieces of membrane material may be applied to the ends 34. In one aspect such pieces are sealingly joined at their edges to the roof covering 20.

Figure 2A:
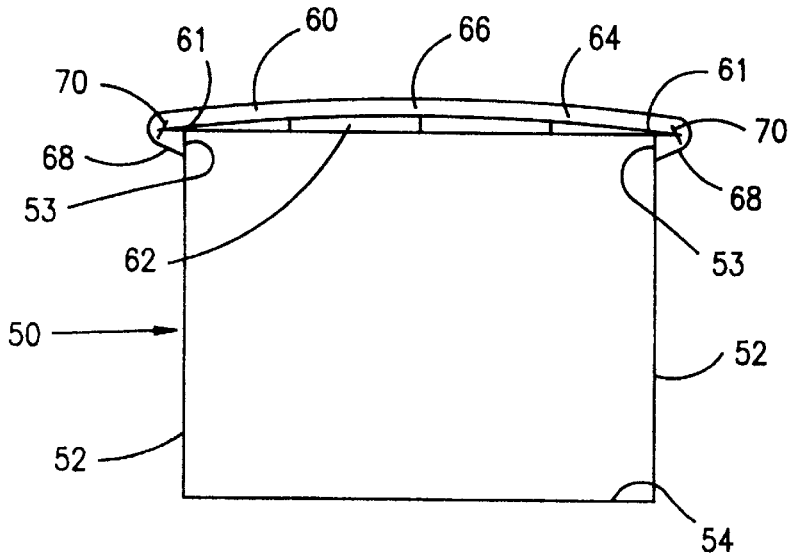
FIG. 2A is a cross-section view of a building as shown in FIG. 2B.
Figure 2B:
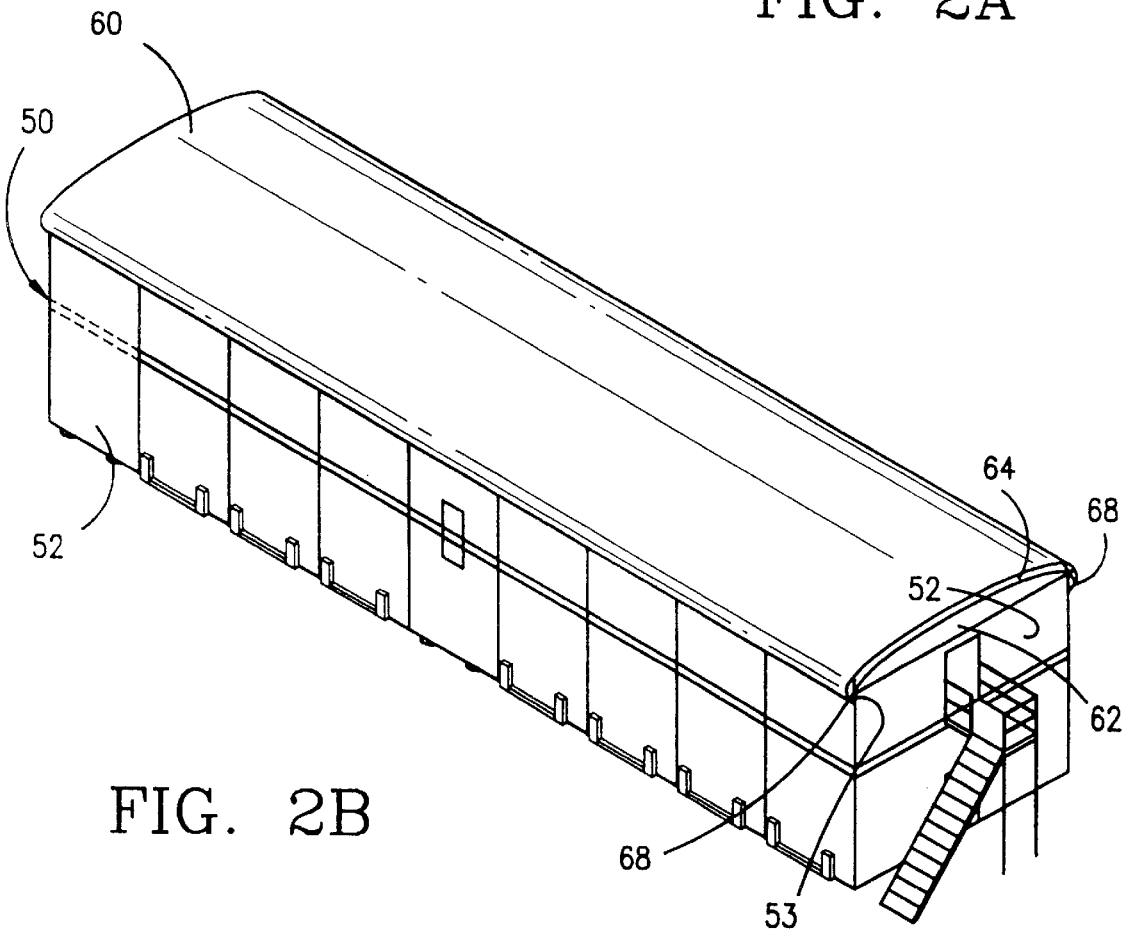
FIG. 2B is a perspective view of a building according to the present invention.

FIG. 2A shows a building 50 according to the present invention with walls 52 (two shown); a floor 54; and a roof system 60 according to the present invention.

The roof system 60 has a truss 62 and a roof covering 64 on the truss 62. The roof covering 64 has a roof member 66 and lower lips 68 that project beneath edge members 61 of the truss 62. The lips 68 also extend down over and are glued to a top portion 53 of the walls 52. Screws 70 (or other suitable fasteners) are used to secure the roof covering 64 to the truss 62. Such fasteners may also extend through the lips 68 into the walls 52. Alternatively, or in addition to the screws 70, adhesive may be used.

FIG. 3A shows a top view of a roof structure 100 according to the present invention covered by flexible roof covering material 102. FIG. 3B is a bottom view of a truss 104 used beneath the roof covering material 102 of the roof structure 100. The truss 104 has a top 112, interconnected sides 108 and 110, and cross-supports or rafters 106.

FIG. 3C is a cross-sectional view through the roof structure 100 (showing both a vertical and a horizontal view through the roof structure 100 as shown in FIG. 3A). The roof covering 102 covers the top 112 of the truss 104, its sides 108 and 110 and a portion of inner side surfaces 116 and 118. It is within the scope of this invention for the covering to cover only one inner side surface or any two opposed inner side surfaces.

FIG. 3D shows a cross-sectional view of the roof covering of the roof structure of FIG. 3A. FIG. 3E shows a cross-sectional view of the roof truss of the roof structure of FIG. 3A.

In addition to the use of flexible material, flexible plastic, flexible fiberglass, or flexible fabric for any roof covering herein, alternatively any suitable spray-on water-repellent material may be used to produce a roof covering according to the present invention, including, in one aspect, spray-on thermoplastic polyurethane material and spray-on thermoplastic polyurethane/polyurea material (referred to collectively as "protective material")—which may also, according to the present invention, be used as covering for a building's floor and/or walls (e.g. but not limited to Line-X™ sprayable materials, BUC XS-350, BUC XS-13, BUC XS-17, BUC XS-Series, and BUC XS-100 sprayable material, commercially available from Burtin Corporation). In one aspect the spray-on material substantially covers one or both primary surfaces of the roof, floor, and/or walls and, optionally, edges thereof. The spray-on covering may be sprayed onto the roof, floor and/or walls either prior to building assembly or thereafter.

FIG. 4 shows a building 150 (in cross section) with a roof structure 100. The building 150 has four walls 152 (three shown) and a floor 154. An upper portion of the walls is in contact with a portion of the roof covering 102 disposed between an exterior of the walls and an interior of the roof truss 104. This portion of the roof covering serves as a sealing gasket between the walls 152 and the roof structure 100.

Figure 5A:
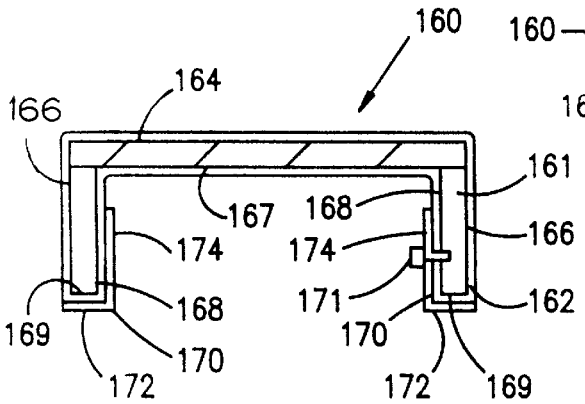
FIG. 5A is a side cross-section view of a roof structure according to the present invention.
Figure 5B:
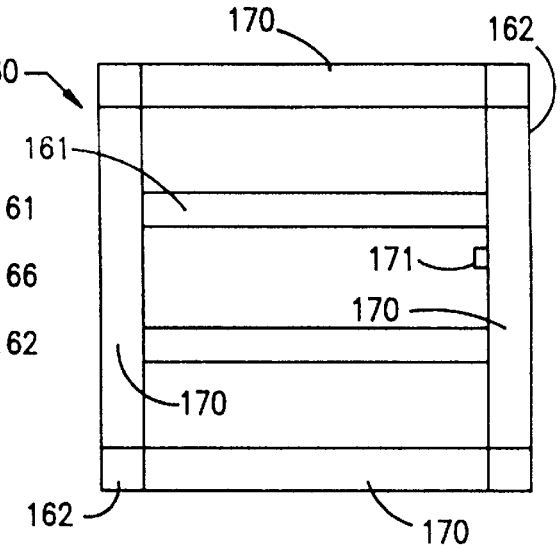
FIG. 5B is a bottom view of the roof structure of FIG. 5A.

FIGS. 5A and 5B show a roof structure 160 like that in FIG. 4 with a truss 161, but with flexible plastic, fiberglass, fabric, or rubber roof membrane material 162 (preferably water-repellent) (collectively "roof material") covering both the exterior surfaces (top 164, sides 166) and the interior surfaces (ceiling 167, sides 168) as well as the lower ends 169 of the sides. Another difference is the use of L-shaped protectors 170 with a lower flat part 172 over the ends 169 of the roof structure 160 and an upper vertical part 174 on the interior sides 168. As shown in FIG. 5B, the protectors 170 cover all the lower end surfaces with the exception of the corners. It is within the scope of this invention for the protectors 170 or for any of the protectors 170 to extend over only a portion of a lower end 169. It is also within the scope of this invention to glue or fasten a solid protective piece on the uncovered corners (see FIG. 5B). Alternatively, the upper vertical part 174 of any of all of the protectors 170 may be on the outside of the roof structure 160.

The protectors 170 (and any protector or angle piece in FIGS. 5A–8B) to be made of a suitable thickness that will not interfere with the emplacement of a roof structure on the walls of a building and to be made of any suitable solid, tape, or foil material, including, but not limited to, aluminum sheet or foil, flat fiberglass pieces, sheet metal, or plastic. The protectors may be glued on (see, e.g., the protector 170 on the left side of FIG. 5A) or they may be attached with a fastener (see, e.g., the screw 171 through the protector 170 on the right side of FIG. 5A). Appropriate adhesives or adhesive tape may also be used to hold the protectors in place. In one aspect the protectors or angle pieces may be thinner than the roof material.

Figure 6:
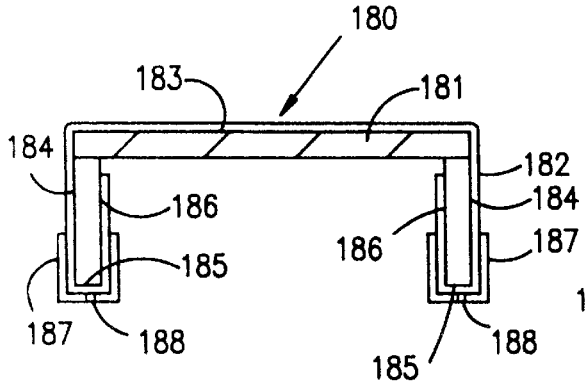
FIG. 6 is a side cross-section view of a roof structure according to the present invention.

FIG. 6 shows a roof structure 180 according to the present invention with a truss 181 and roof membrane material 182 covering the exterior surfaces (top 183, sides 184, ends 185) and a portion of the interior surface (sides 186). U-shaped protectors 187 cover the ends 185 and extend all around the roof structure 180 (as do the protectors 170 in FIG. 5B). For fluid drainage, the protectors 187 may have one or more holes 188. FIGS. 5A–8B are schematic and the thicknesses of various items shown are merely illustrative. Any suitable thickness of roof membrane material or of protector material may be used. The protectors 170 have two members at a right angle to each other and the protectors 187 have three members. It is within the scope of this invention for the protectors (and angle pieces, FIG. 7) to be integral pieces or made up of separate pieces each individually adhered to, attached to, and/or connected to (e.g. with fasteners or Velcro™ material). From below, the roof structures of FIGS. 6–8A look like that of FIG. 5B (or any of them may be rectangular, trapezoidal, circular, triangular or any desired shape).

Figure 7:
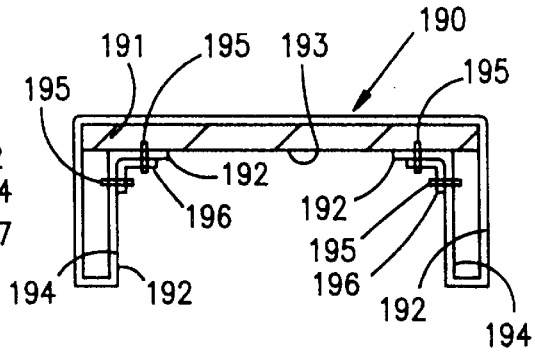
FIG. 7 is a side cross-section view of a roof structure according to the present invention.

FIG. 7 shows a roof structure 190 according to the present invention with a truss 191 covered exteriorly and partially interiorly with flexible roof material 192. Attached to a ceiling 193 and interior sides 194 with screws 195 are angle pieces 196. The screws 195 extend through the roof material 192. Instead of, or in addition to the screws, suitable adhesives and/or tape may be used. The angle pieces may be the length of the interior sides or some shorter length. If the length is shorter, one, two, three, four or more may be used on each side. The protectors, angle pieces, and attachment pieces disclosed herein may be the same thickness as the roof material or they may be thicker or thinner than the roof material.

Figure 8A:
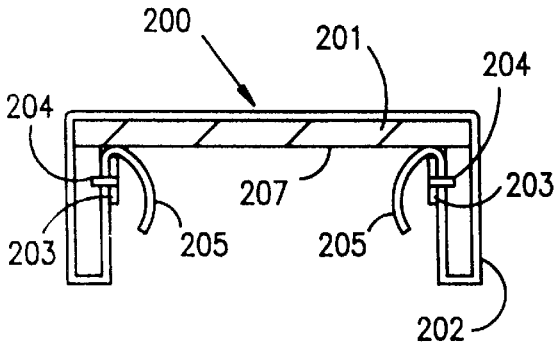
FIG. 8A is a side cross-section view of a roof structure according to the present invention.
Figure 8B:
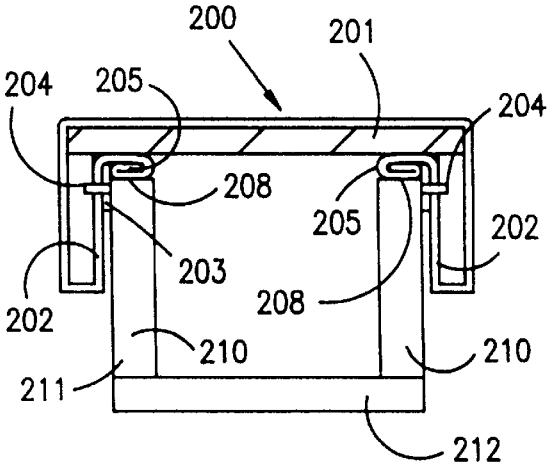
FIG. 8B is a side cross-section view showing the roof structure of FIG. 8A on a building according to the present invention.

FIGS. 8A and 8B show a roof structure 200 according to the present invention with a truss 201 and roof material 202. End portions 205 of the roof material 202 hang over attachment pieces 203 adhered to the roof material and/or affixed to the truss sides with screws 204. As shown in FIG. 8B, the end portions 205 are disposed between a lower surface 207 of the truss 201 and upper ends 208 of walls 210 of a building 211 having a floor 212. The end portions 205 serve as a gasket and/or seal. The attachment pieces may be any suitable solid, soft, or flexible material and may also serve as a gasket or seal between the roof structure and walls. The building 211 represents any building suitable for emplacement thereon of a roof structure 200. The roof material 202 may be any desired thickness and the end portions 205 may be any desired length, i.e., the end portions 205 may extend beyond the top of the attachment pieces 203 any desired length. Alternatively, one, two, three, four or more thicknesses of the roof material 202 may be folded on themselves and secured to the lower surface 207 of the truss 201 to serve as a seal and/or gasket.

Figure 9:
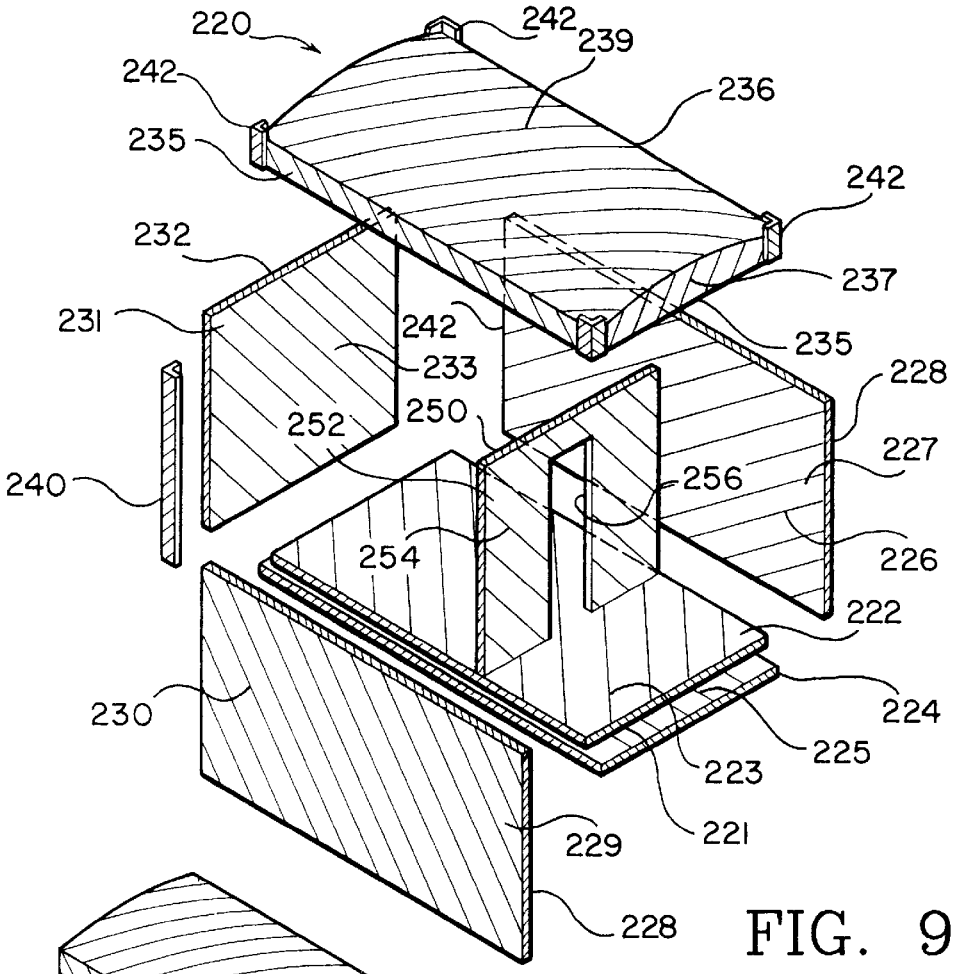
FIG. 9 is an exploded view of a building and components thereof according to the present invention.

FIG. 9 shows a building 220 (exploded view) according to the present invention which is like a prior art building except for covering material, which in one aspect is spray-on material on the components of the building. The cross-hatching on the various components indicates coating, e.g. a layer of sprayed-on material, e.g., but not limited to, a layer of sprayed-on thermoplastic polyurea or sprayed-on thermoplastic polyurethane/polyurea. In one aspect the coating of such sprayed-on material is applied by known apparatus to a desired thickness, e.g. between about 1/16" to 3/8". A floor 222 rests on a support 224 (which can be any known skid, foundation, or support). The floor 222 has a coating 223 of covering material. Optionally an underside of the floor 222 is also coated with the covering material and/or edges 221 are similarly, optionally, coated as, optionally, are the edges of the other components of the building 220. The support 224 has a coating 225. An underside surface of the support 224 may also be coated. An interior surface 227 of each side walls 228 is coated with coating 226 and, optionally, outside surfaces 229 may also be coated with a coating 230. An interior surface 231 of an end wall 230 is coated with a coating 233 and, optionally, an exterior surface 232 is also coated with a coating 237. A roof structure or truss 236 has a top coating or layer 239 and its sides 235 are also coated with a coating 237. An underside of the roof truss 236 may also be coated. Alternatively, only exterior surfaces of the building 220 may be coated, prior to or following assembly. An end wall 250 with a door opening 256 has an exterior surface 252 with a coating 254. The interior of the end wall 250 may also be coated.

Any part or component of the building 220 may be coated, covered, or layered partially or entirely, interiorly and/or exteriorly, with any coating, covering, or material disclosed herein.

In one aspect the building 220 is a portable building, movement of the building 220 is facilitated by its emplacement on the support 224. In one aspect wheels (not shown) on axles (not shown) may be mounted beneath the building with appropriate associated structure for transport of the building.

Sub-components of the building 220 may include any known structures and apparatus, e.g., but not limited to, galvanized corners 240 (one at each corner, one shown) and roof corners 242 may be coated exteriorly and/or interiorly, prior to or following building assembly. Any known gasket material and/or sealing material may be used to seal any interface between parts of the building 220.

Figure 10A:
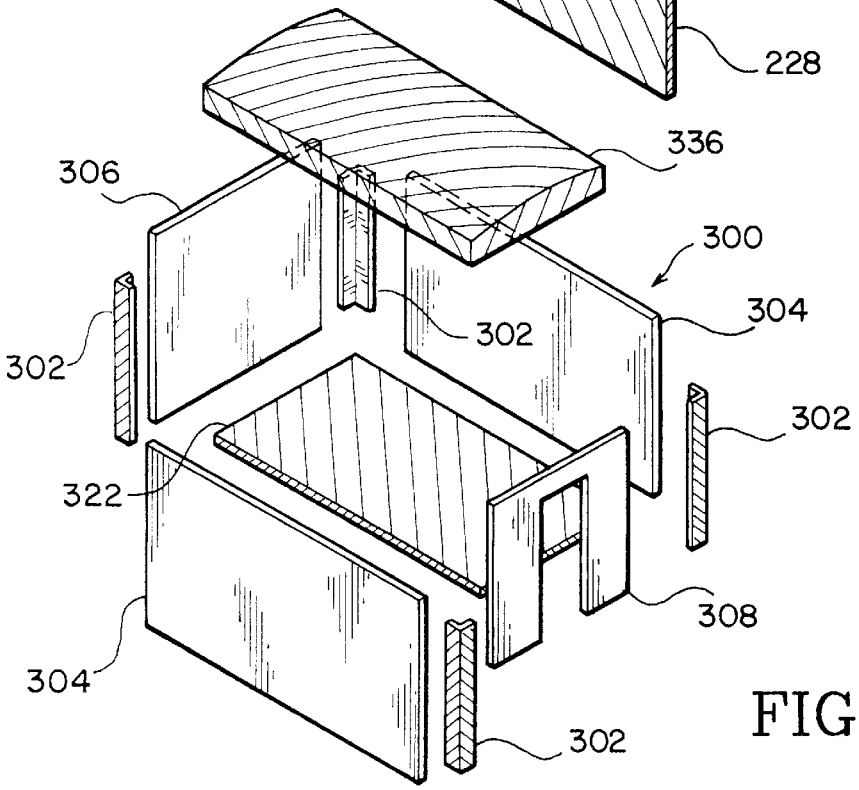
FIG. 10A is an exploded view of a building according to the present invention.
Figure 10B:
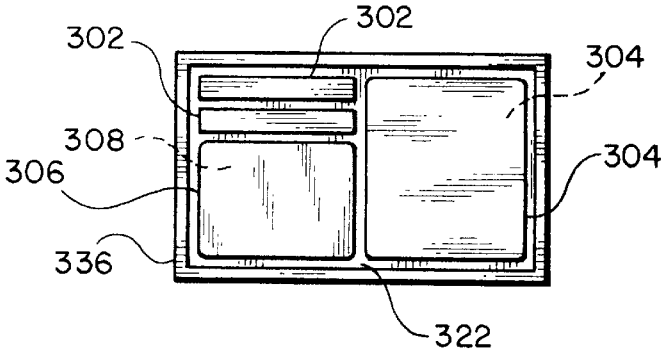
FIG. 10B is a top view of the roof of the building of FIG. 10A containing the building components.

FIGS. 10A and 10B show a building 300 according to the present invention with a floor 322 (like the floor 222) and a roof 336 (like the roof truss 236). The floor and roof may be coated as are the floor and roof of the building 220. Braces or pillars 302 are securable to the floor 322 to support the roof 336.

Side walls 304, an end wall 306, and an end wall 308 are "soft sided," i.e. they are non-rigid. In certain aspects these walls are made of flexible plastic sheet material, Nylon, blanket material, fiberglass blanket material, rubber sheets, canvass, or cloth. In other aspects these "soft sided" walls include one or more layers of the previously mentioned materials and one or more layers of insulation materials, including, but not limited to bubble wrap material, cellulose sheets or pads, and/or fiberglass insulation. In other aspects, these walls may be made of air inflatable parts or modules. In other aspects, supports or pillars, including but not limited to pillars such as the pillars 302 above, may be air inflatable structures or modules.

The walls may be secured, releasably or permanently, to the floor, braces and/or roof with suitable fasteners, grommets, glue, adhesive and/or Velcro™ material. Also or alternatively, the edges of adjacent walls may be fixed, releasably or permanently, to each other. Holes and/or transparent portions may be provided in any wall.

Figure 10C:
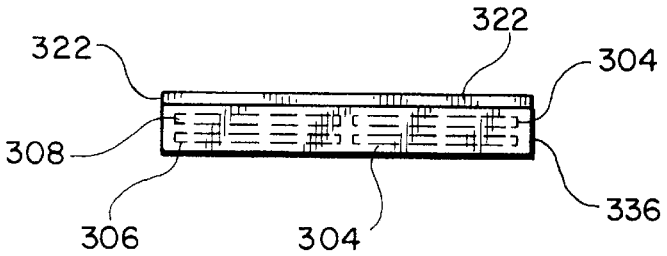
FIG. 10C is a side view of the roof and floor of a building as in FIG. 10A with the floor serving as a cover over the hollow roof.

FIG. 10B shows the components of the building 300 stored within the roof 336 (with the flexible walls folded to fit within the roof). The floor 322 is optional, or if properly sized, may serve as a cover over the roof opening as in FIG. 10C (instead of being sized to fit within the hollow roof as shown in FIG. 10B). The floor itself may be made of multiple parts.

Figure 10D:
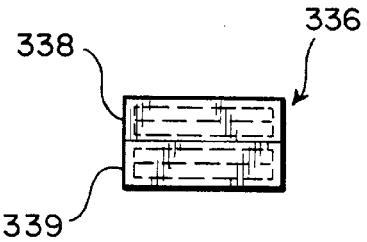
FIG. 10D is a side view of an alternative roof embodiment.

FIG. 10D shows an alternative embodiment of the roof 336 in which the roof comprises two hollow parts 338 and 339 which are either hingedly connected or stackable as shown. Building components within the roof parts are indicated by dotted lines.

Alternatively, one or more of the walls of the building 300 may be rigid. In one aspect the floor is rigid and hollow, the roof is soft-sided, and the building components are all storable within the floor. Instead of the floor 322, the building may be mounted on any suitable skid. It is also within the scope of this invention for the roof and braces to support a second (third, and/or fourth or more) additional stories above the roof 336.

Figure 11:
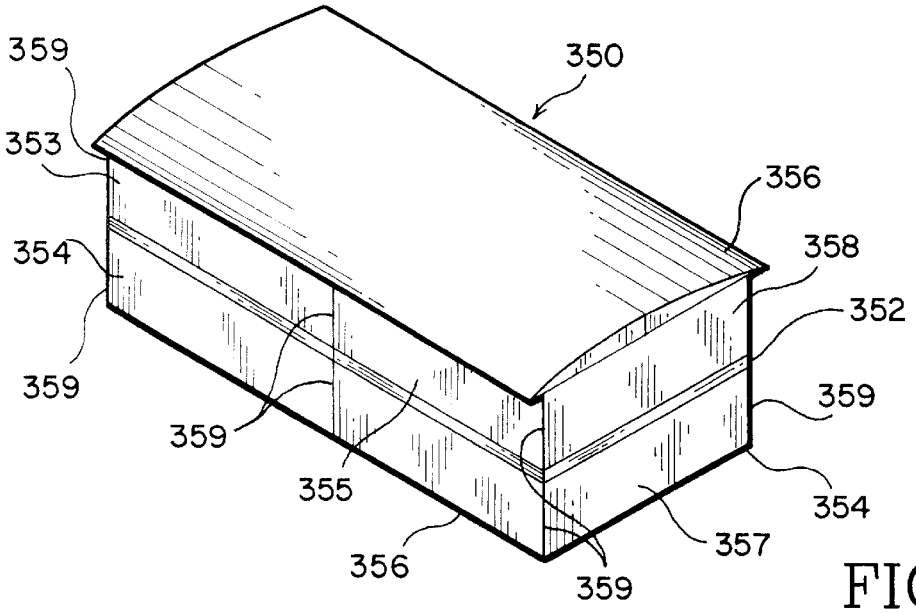
FIG. 11 is a perspective view of a building according to the present invention.

FIG. 11 shows a multi-story building 350 according to the present invention with a roof 356 (like the roof 336, FIG. 10A), an intermediate floor 352 (like the floor 322, FIG. 10A) and a floor 354 (like the floor 322, FIG. 10A; or a known skid). All of the walls 353, 354, 355 356, 357, 258 (and walls not visible in the view of FIG. 11) are soft-sided as discussed above. Alternatively, one or some of these walls may be rigid. Frame elements 359 may be wood, steel, rigid plastic, air inflatable structures, and/or any suitable support material. Frame elements are used around the building as needed.

In one aspect the walls of the first story may be rigid and the walls of the second story are soft-sided, or vice-versa. Each story may be an individual module mountable on a story below and in certain aspects, supporting a story above.

A hollow roof 356 and a hollow floor 352 are combinable to form a storage/shipping container for all or the major part of the building's components. In another aspect a hollow roof is covered by the floor to form the container. Alternatively (as in FIG. 10D) either the roof 356 or the floor 352 or both may be made of stackable and/or connectible parts.

Buildings as the buildings 300 and 350 are easily transportable and, with appropriate component sizing, are helicopter-transportable. The roof and/or floors of such buildings may be coated as previously described herein.

Figure 12A:
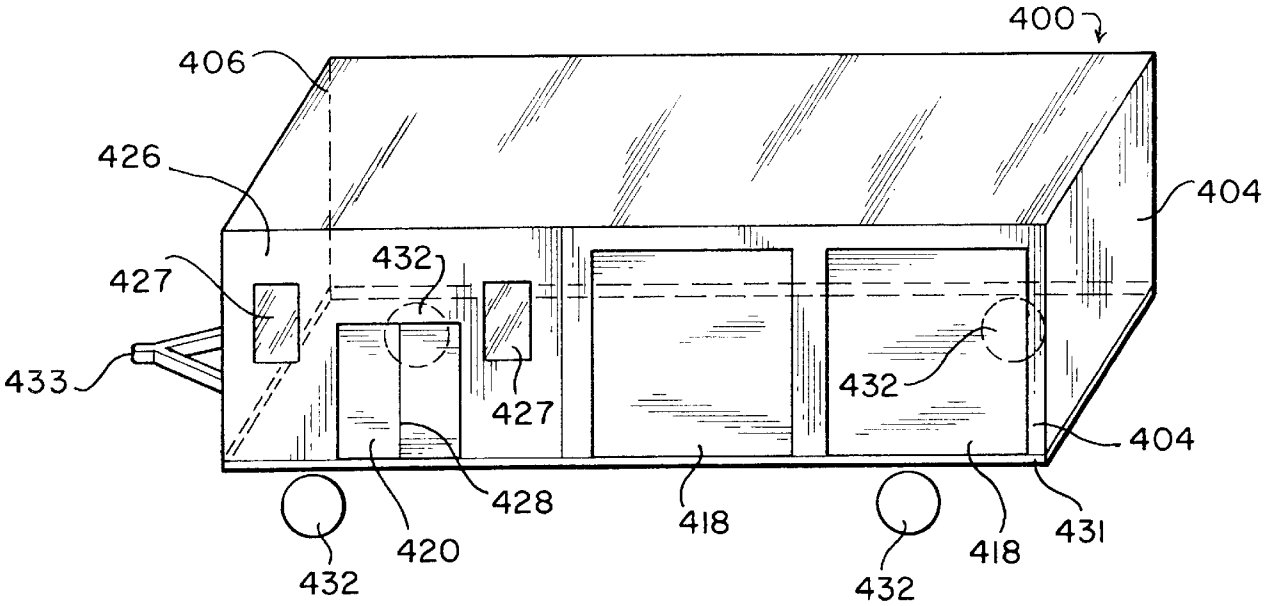
FIG. 12A is a perspective view of a building according to the present invention and FIG. 12B is a top plan view of the building of FIG. 12A with the roof removed.
Figure 12B:
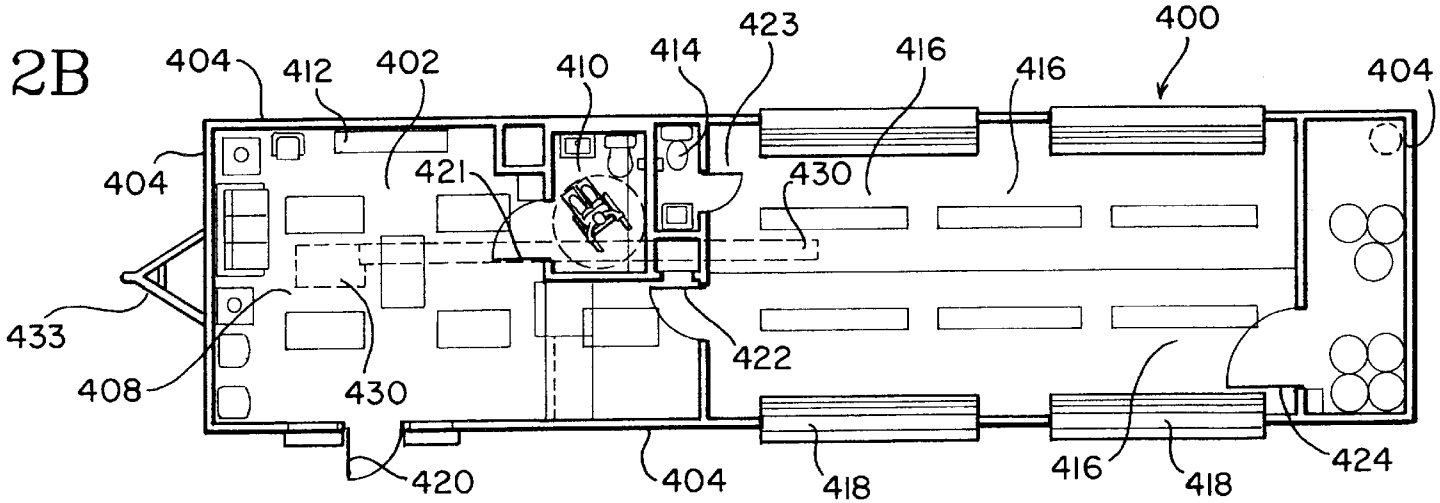

FIGS. 12A and 12B show a building 400 according to the present invention with a floor 402, walls 404, and a roof 406. The building 400 provides, in certain aspects, a facility for automotive services and repairs. Within the building are a waiting area 408 for customers; an office area 410; a storage area 412; a bathroom area 414; and three automotive bay areas 416 and two roll-up garage doors 418 (three or four such doors may be used). Doors 420, 421, 422, 423, and 424 provide access to the various areas of the building. Pane glass windows 427 are provided at the front 426 of the building and the front door 428 may, optionally, also be a pane glass door. The roof 406 may be any suitable known prior art roof or, in certain aspects, it is a roof as any roof described herein. The walls 404 may be any suitable wall, including but not limited to, any wall disclosed herein. The floor in the bay area may be wood or wood with steel plate over it. An optional central air treatment unit 430 (shown schematically in dotted lines, may be anywhere in or on the building) provides cooling and/or heating for the building or for desired parts of it (e.g., but not limited to, the waiting area, office area, bathroom area, and/or bay areas).

Figure 12C:
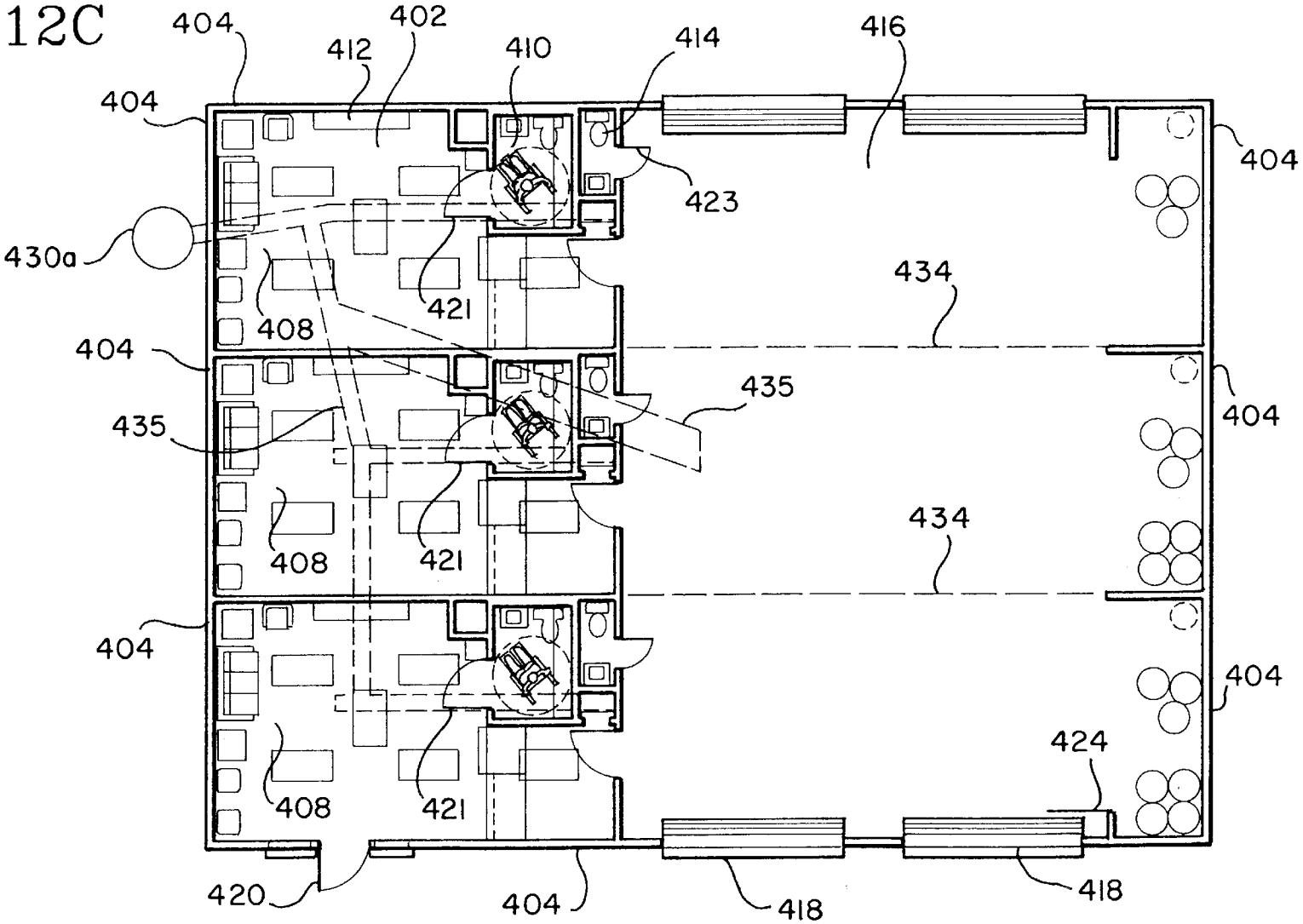
FIG. 12C is a top view of a building according to the present invention.

The building 400 may be transported on a suitable trailer, e.g. the trailer 431 with wheels 432 and trailer tongue 433 (FIG. 12A). As shown in FIG. 12C, multiple buildings like the building 400 may be placed adjacent each other to form a combined building that is wider and/or longer than the individual building 400. Optional walls 434 may be placed between areas of the building or an enlarged open area (e.g. bays area or customer area, etc.) may be created by placing individual building next to each other and opening and/or removing walls or part thereof. A heater and/or air conditioner unit 430*a* is mounted exteriorly of the building in FIG. 12C with ducts 435 to various parts of the building. Air ducts may be in any suitable part of the building, including but not limited to, in the floor and/or ceiling. Although three "modules" like the building 400 are shown in FIG. 12C, it is within the scope of this invention to use two, four or more of such "modules" to form a combined building of any desirable dimensions. Also, only a part of a building 400 may be combined with an entire building 400 e.g. to produce a larger retail area, a larger office area, larger bay area, etc.

The present invention, therefore, in some, but not necessarily all, embodiments, provides a portable building with a plurality of interconnected walls defining an interior space therebetween, a floor on which the walls are positioned, a roof structure connected on top of the walls, and at least one bay area or a plurality of bay areas for servicing an automobile. Such a portable building may have one or some of the aspects in any possible combination as stated in the claims appended hereto.

The present invention, therefore, in certain aspects, provides a roof structure for a building, the roof structure having a roof member and a covering on the roof member, the covering comprising spray-on thermoplastic polyurethane; such a roof structure wherein the roof member has an outer edge and the outer edge of the roof member comprises two pairs of opposed edges, and the roof covering having a lower lip projecting inwardly beneath the outer edge of the roof member; such a roof structure wherein the roof covering covers substantially all of the roof member; such a roof structure wherein the walls have top ends disposed within the roof member and the roof covering has inner ends disposed between a top interior surface of the roof member and the top ends of the walls; such a roof structure wherein the roof member is a truss with a top member, a bottom member, and side members interconnected between the top and bottom members, and which in one aspect, the roof member is positionable on upright walls of a building with top portions of the walls within the roof member, and wherein the side members have lower ends, the roof structure further including protectors outside the roof covering, the protectors covering at least a portion of the lower ends; such a roof structure wherein the roof member has interconnected sides having an outer surface and an inner surface, and the roof covering covers the outer surfaces of the sides of the roof member and at least a portion of the inner surfaces of the sides of the roof member; such a roof structure wherein the covering is between about 1/16" and about 3/8" thick; and such a roof structure wherein the roof member has a top exterior surface and a bottom interior surface and the covering is on the top exterior surface, on the bottom interior surface, or on both.

The present invention discloses a building with a plurality of interconnected walls defining an interior space therebetween, a floor on which the walls are positioned, and a roof structure connected on top of the walls, the roof structure having a roof member, and a covering on the roof member, the covering comprising spray-on thermoplastic polyurethane; such a building with a covering on the floor, the covering covering the floor and comprising spray-on thermoplastic polyurethane material; such a building with a covering on the walls, the covering covering the walls and comprising spray-on thermoplastic polyurethane material; such a building wherein the outer edge of the roof member comprises two pairs of opposed edges and the covering having a lower lip projecting inwardly toward the walls beneath the outer edge of the roof member and positioned adjacent to and beneath the two pairs of opposed edges; such a building wherein the roof covering covers substantially all of the roof member; such a building wherein the roof member has a top exterior surface and a bottom interior surface and the covering is on the top exterior surface, on the bottom interior surface, or on both; such a building wherein each of the roof member, floor and walls has an interior surface and an exterior surface and all surfaces have a covering thereon of spray-on thermoplastic polyurethane; and such a building wherein the building is portable and includes a building support beneath and supporting the building, the building support having a covering thereon of spray-on thermoplastic polyurethane.

The present invention also discloses a building with a plurality of interconnected walls defining an interior space therebetween, a floor on which the walls are positioned, and a roof structure connected on top of the walls, the roof structure comprising a roof member, a roof covering on the roof member, the roof covering comprising spray-on thermoplastic polyurethane, a floor covering on the floor, the floor covering comprising spray-on thermoplastic polyurethane material, a wall covering on the walls, the wall covering comprising spray-on thermoplastic polyurethane material, wherein each of the roof member, floor and walls has an interior surface and an exterior surface and all surfaces have a covering thereon of spray-on thermoplastic polyurethane, and a building support beneath and supporting the building, the building support having a covering thereon of spray-on thermoplastic polyurethane.

The present invention, therefore, provides, in at least certain if not all embodiments, a building with a plurality of interconnected walls defining an interior space therebetween, at least one of said walls made of non-rigid material, a floor on which the walls are positioned, and a roof structure connected on top of the walls, the roof structure with a roof member, and a covering on the roof member, the covering including spray-on protective material. Such a building may have one, some or all of the following: a covering on the floor, the covering covering the floor and comprising spray-on thermoplastic polyurethane material; a covering on the walls, the covering covering the walls and comprising spray-on thermoplastic polyurethane material; wherein the outer edge of the roof member is two pairs of opposed edges and the covering having a lower lip projecting inwardly toward the walls beneath the outer edge of the roof member and positioned adjacent to and beneath the two pairs of opposed edges; wherein the roof covering is spray-on thermoplastic polyurethane material; wherein the roof member has a top exterior surface and a bottom interior surface and the covering is on the top exterior surface; wherein the roof member has a top exterior surface and a bottom interior surface and the covering is on the bottom interior surface; wherein each of the roof member, floor and walls has an interior surface and an exterior surface and all surfaces have a covering thereon of spray-on thermoplastic polyurethane; wherein the building is portable and includes a building support beneath and supporting the building, the building support having a covering thereon of spray-on thermoplastic polyurethane; wherein the at least one wall is each wall of the plurality of interconnected walls; wherein the at least one wall is made of material from the group consisting of flexible plastic sheet, rubber sheet, canvas and cloth; wherein the at least one wall includes at least one layer of insulating material; wherein the at least one wall is an air-inflatable structure; wherein the roof structure is made of non-rigid material; wherein the roof structure includes a body with a hollow interior and the floor and walls are storable within the hollow interior; and/or wherein the floor includes a body with a hollow interior and the roof and walls are storable within the hollow interior.

The present invention, therefore, provides, in at least certain if not all embodiments, a building with a plurality of interconnected walls defining an interior space therebetween, at least one of said walls made of non-rigid material, a floor on which the walls are positioned, and a roof structure connected on top of the walls, the roof structure having a roof member, a roof covering on the roof member, the roof covering including spray-on protective material, a floor covering on the floor, the floor covering including spray-on protective material, a wall covering on the walls, the wall covering including spray-on protective material, wherein each of the roof member, floor and walls has an interior surface and an exterior surface with a covering thereon of spray-on protective material, and a building support beneath and supporting the building, the building support having a covering thereon of spray-on protective. Such a building may have spray-on protective material that is spray-on thermoplastic polyurethane. In such a building the at least one wall may be each wall of the plurality of interconnected walls. In such a building the roof structure may include a body with a hollow interior and the floor and walls are storable within the hollow interior.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112.

What is claimed is:

1. A portable building for automobile service comprising a plurality of interconnected walls defining an interior space therebetween, a floor on which the walls are positioned, a roof structure connected on top of the walls, at least one bay area for servicing an automobile, and at least one of said floor, roof structure, or one wall of said plurality of interconnected walls covered with sprayed-on thermoplastic material, wherein the roof structure has an outer edge comprising two pairs of opposed edges and the covering having a lower lip projecting inwardly toward the walls beneath the outer edge of the roof member and positioned adjacent to and beneath the two pairs of opposed edges.

2. The portable building of claim 1 wherein the roof structure comprises a roof member, and a covering on the roof member, the covering comprising spray-on protective material.

3. The portable building of claim 2 wherein the roof covering is spray-on thermoplastic polyurethane material.

4. The portable building of claim 1 further comprising a covering on the floor, the covering covering the floor and comprising spray-on thermoplastic material.

5. The portable building of claim 1 further comprising a covering on the plurality of interconnected walls, the covering covering the plurality of interconnected walls and comprising spray-on thermoplastic material.

6. The portable building of claim 1 wherein the roof member has a top exterior surface and a bottom interior surface and the covering is on the top exterior surface.

7. The portable building of claim 1 wherein the roof member has a top exterior surface and a bottom interior surface and the covering is on the bottom interior surface.

8. The portable building of claim 1 wherein each of the roof member, floor and walls has an interior surface and an exterior surface and all surfaces have a covering thereon of spray-on thermoplastic material.

9. The portable building of claim 1 wherein the portable building includes a building support beneath and supporting the building, the building support having a covering thereon of spray-on thermoplastic material.

10. The portable building of claim 1 wherein the walls are made of material from the group consisting of flexible plastic sheet, rubber sheet, canvas and cloth.

11. The portable building of claim 1 wherein the roof structure is made of non-rigid material.

12. The portable building of claim 1 wherein the roof structure includes a body with a hollow interior and the floor and walls are storable within the hollow interior.

13. The portable building of claim 1 wherein the floor includes a body with a hollow interior and the roof and walls are storable within the hollow interior.

14. The portable building of claim 1 wherein the at least one bay area is a plurality of bay areas.

15. The portable building of claim 1 further comprising a trailer on which the building is removably mounted.

16. The portable building of claim 1 wherein the at least one bay area has two spaced-apart ends with a garage door at each of said ends.

* * * * *